United States Patent [19]

Kamohara

[11] Patent Number: 4,503,355

[45] Date of Patent: Mar. 5, 1985

[54] MASK-FOCUSING COLOR PICTURE TUBE

[75] Inventor: Eiji Kamohara, Fukaya, Japan

[73] Assignee: Tokyo Shibaura Denki Kabushiki Kaisha, Kawasaki, Japan

[21] Appl. No.: 392,244

[22] Filed: Jun. 25, 1982

[30] Foreign Application Priority Data

Jun. 26, 1981 [JP] Japan ..... 56-98200

[51] Int. Cl.[3] ..... H01J 29/07

[52] U.S. Cl. ..... 313/402; 313/408

[58] Field of Search ..... 313/402, 403, 407, 408, 313/432

[56] References Cited

U.S. PATENT DOCUMENTS

| | | | |
|---|---|---|---|
| 2,971,117 | 2/1961 | Law | 315/13 |
| 3,502,942 | 3/1970 | Khan et al. | 315/31 |
| 3,668,002 | 6/1972 | Okabe et al. | 117/210 |
| 3,944,867 | 3/1976 | Kaplan | 313/403 |
| 4,059,781 | 11/1977 | Van Alphen et al. | 313/403 |
| 4,066,923 | 1/1978 | Van Esdonk | 313/402 |
| 4,107,569 | 8/1978 | Ronde | 313/402 |
| 4,112,563 | 9/1978 | Van Esdonk | 445/47 X |
| 4,379,251 | 4/1983 | Brouha et al. | 313/403 |

FOREIGN PATENT DOCUMENTS 0058992 9/1982 European Pat. Off. .

*Primary Examiner*—David K. Moore
*Assistant Examiner*—K. Wieder
*Attorney, Agent, or Firm*—Cushman, Darby & Cushman

[57] ABSTRACT

A mask-focusing color picture tube comprising an evacuated envelope; electron gun to generate a number of electron beams; a display screen comprising a large number of phosphor stripes luminescing in different colors; a plurality of shadow masks being spaced in the predetermined distance each other, individually having a number of apertures which is arranged in rows and being disposed in the vicinity of the screen, each electron beam being assigned to phosphor stripe of a respective color through the corresponding mask aperture. At least one of the plurality of shadow masks has a plurality of projections on at least one surface of the shadow mask. The projections are separated from each other by the rows of the apertures. At least part of the projections are located at nonsymmetrical positions with respect to the centers of the apertures.

17 Claims, 7 Drawing Figures

MASK-FOCUSING COLOR PICTURE TUBE

BACKGROUND OF THE INVENTION

The present invention relates to a mask-focusing color picture tube in which a plurality of shadow masks are opposed to a phosphor screen at a small distance therefrom and are insulated from each other to define an electrostatic lens by themselves or with a phosphor screen and, more particularly, to a shadow mask structure in such a color picture tube.

In a color picture tube with a conventional shadow mask, the electron beam utility factor is as low as about 20% due to the presence of the shadow mask, and the brightness of the screen is limited. It is known that the best method to improve brightness is to increase the aperture diameter of the shadow mask and post-focus the electron beams. As a color picture tube which improves brightness, a mask-focusing color picture tube is proposed in which an electrostatic lens is formed in the vicinity of a shadow mask. Such a mask-focusing color picture tube is described in Japanese Patent Disclosure Nos. 79963/1973 and 38580/1976, Japanese Patent Publication Nos. 8261/1972 and 31265/1972, Utility Model Registration Publication No. 40681/1977, and U.S. Pat. Nos. 2,971,117 and 4,112,563.

Among these mask-focusing picture tubes, those which use a single shadow mask require that a voltage applied to a metal-backed phosphor screen must be much higher than a voltage applied to the shadow mask. Therefore, secondary electrons generated from the shadow mask are accelerated to impinge upon the screen, thus reducing the clarity of image and lowering the contrast, which is undesired in practice.

In the other mask-focusing color picture tubes, the electrostatic lenses are formed by predetermined potential differences between a plurality of shadow masks. In these color picture tubes, since the focusing power of the electrostatic lens is weak, a great potential difference must be set between the shadow masks. Then, an arc may occured between the shadow masks, which is a serious problem.

Another type of mask-focusing color picture tube is also known in which grill-shaped shadow masks are arranged to form quadrupole lenses in the apertures of the shadow masks so as to enhance focusing force in one direction. However, the grill-shaped shadow masks are inferior in mechanical strength and formability. Therefore, such a color picture tube is also impractical.

As an improvement over these tubes, a mask-focusing color picture tube with projections in the vicinities of the shadow mask apertures has also been proposed in U.S. Ser. No. 351,882. One of the coinventors of this application is also the inventor of the present invention. The structure of the shadow masks of this tube is shown in FIG. 1.

In two shadow masks 1 and 2 shown in FIG. 1, ridge-like projections 3 and 4 are respectively symmetrically arranged with shadow mask apertures 5 and 6 disposed therebetween. These ridge-like projections 3 and 4 oppose each other and extend in the same direction as that of phosphor stripes coated on the screen (not shown). In the shadow masks of this arrangement, lines of strong electric force are induced from the projections 4 to the projections 3. Therefore, an electrostatic lens of stronger focusing power than that obtainable without the projections may be formed. However, at the peripheries of these shadow masks, the deflected electron beam becomes incident on the surface of the shadow mask at a great incident angle. Therefore, the principal plane of the electrostatic lens formed between the shadow masks is inclined with respect to the optical path of the incident electron beam. The central axes of the electron beams which have passed through the apertures of the shadow masks 1 and 2 largely move with fluctuations in the potential difference between the shadow masks 1 and 2. This state is shown in FIG. 2. For the sake of simplicity, FIG. 2 shows a section, along the plane including axes X and Z, of the parts of the shadow masks 1 and 2 at a given distance on the X axis from the centers O' of the shadow masks 1 and 2.

Referring to FIG. 2, line l connecting the centers of apertures 5 and 6 of the shadow masks 1 and 2 coincides with a central axis m of an incident electron beam 7. Surfaces 8 of the shadow masks 1 and 2 form an angle $\theta$ with respective to the central axis m of an incident electron beam 7. Thus, as may be shown by the dotted line in FIG. 2, the central axis m of the incident electron beam 7 forms an incident angle $$\left(\frac{\pi}{2} - \theta\right)$$

with respect to the principal plane n of an electrostatic lens 9. Therefore, with fluctuations in the focusing power of the electrostatic lens 9 due to fluctuations in the potential difference between the shadow masks 1 and 2, a central axis o of an electron beam 10 which passed through the lens 9 toward a phosphor screen 11 also fluctuates. This phenomenon is well known as the coma aberration of lens. Such fluctuations in the central axis o of the electron beam 10 which has passed through the lens 9 prevents the electron beam from bombarding on the corresponding phosphor stripe and degrades the color purity. In order to solve this problem, the electron beam must be made to become incident perpendicularly to the surface of the shadow mask even at the periphery thereof. However, it is normally difficult to accomplish this, since the deflection center of the electron beam does not generally coincide with the radius of curvature of the shadow mask.

SUMMARY OF THE INVENTION

It is an object of the invention to provide a mask-focusing color picture tube wherein miss-landing of electron beams is prevented even at the periphery of a phosphor screen, at which the electron beam do not normally become perpendicularly incident does shadow masks, so that degradation in color purity may be prevented.

In order to achieve the above object, there is provided according to the present invention a mask-focusing color picture tube comprising: an evacuated envelope; means to generate a number of electron beams; a display screen comprising a large number of phosphor stripes luminescing in different colors; a plurality of masks being spaced a predetermined distance from each other, individually having a number of apertures which are arranged in rows and being disposed in the vicinity of said screen, each electron beam being assigned to phosphor stripe of a respective color through said corresponding mask aperture, wherein at least one of said plurality of shadow masks has a plurality of projections on at least one surface of said shadow mask, said projections being separated from each other by the rows of said apertures and at least part of said projections being located at non-symmetrical positions with respect to the centers of the apertures.

DETAILED DESCRIPTION OF THE PREFERRED EMBODIMENTS

The present invention provides an improvement in a mask-focusing color picture tube which has shadow masks with projections formed in the vicinities of shadow mask apertures. In a mask-focusing color picture tube, color purity is generally degraded since the electron beams do not become perpendicularly incident on the parts of the shadow mask surfaces which are far in the horizontal direction from the vertical axes (vertical lines including the centers of the shadow masks) of the shadow masks. According to the present invention, this degradation in the color purity is improved by horizontally offsetting the projections located at the right and left sides of the apertures in accordance with the incident angles of the electron beams.

The present invention will now be described in more detail with reference to the accompanying drawings.

Figure 1:
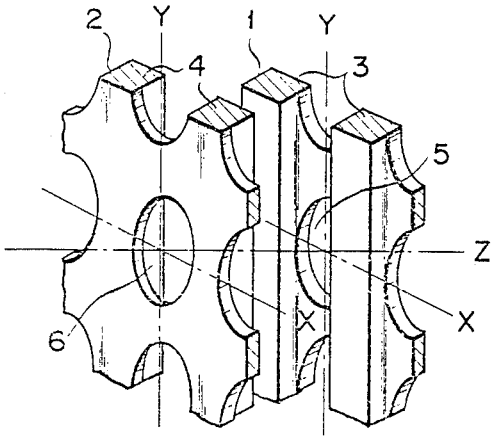
FIG. 1 (PRIOR ART)
FIG. 1 is a partial enlarged view of conventional shadow masks.
Figure 2:
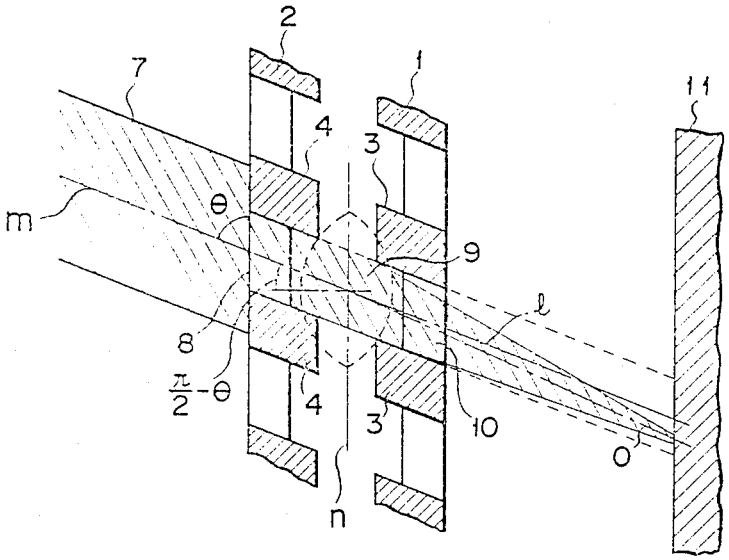
FIG. 2 (PRIOR ART)
FIG. 2 is a sectional view of shadow masks in FIG. 1 along the plane including axes X and Z.
Figure 3:
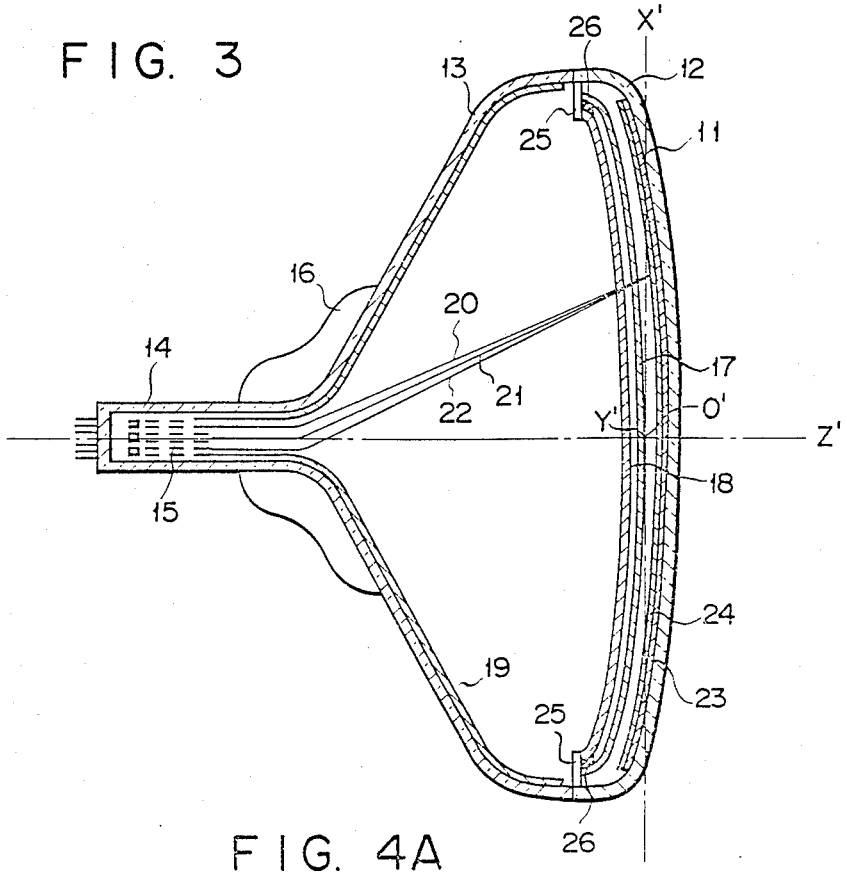
FIG. 3 is a sectional view of a mask-focusing color picture tube according to the present invention.

FIG. 3 is a schematic sectional view showing the arrangement of a mask-focusing color picture tube of the present invention. In a mask-focusing color picture tube shown in FIG. 3, a funnel 13 is joined to the outer periphery of a faceplate 12, on the inner surface of which is formed a phosphor screen 11. A neck 14 is joined to the end of the funnel 13. Electron guns 15 are disposed in the neck 14. A deflection apparatus 16 is mounted over the outer surfaces of the funnel 13 and of the neck 14. A first shadow mask 17 opposes the phosphor screen 1, and a second shadow mask 18 opposes the first shadow mask 17. The second shadow mask 18 is mounted to the faceplate 12 by a mask frame 25 and another support means (not shown), while the first shadow mask 17 is mounted to the second shadow mask 18 through an insulating member 26. The phosphor screen 11 comprises phosphor stripes 23 of regularly alternating three colors coated on the inner surface of the faceplate 12, and a thin metal back layer 24 formed on the phosphor stripes 23. A conductive film 19 is uniformly coated on the inner surface of the funnel 13 and on part of the inner surface of the neck 14.

In a color picture tube of the arrangement described above, three electron beams 20, 21 and 22 emitted from the electron guns 15 are deflected by the deflection apparatus 16, are selectively focused by the second and first shadow masks 18 and 17, pass through the metal back layer 24, and are emitted on the respective phosphor stripes 23 which then emit light of the corresponding colors.

The potentials of the phosphor screen 11, the conductive film 19 on the inner surface of the funnel 13, the first shadow mask 17 and the second shadow mask 18 may be set through suitable connectors (not shown) from several anode buttons (not shown) mounted on, for example, the funnel 13. An anode high voltage is applied to the phosphor screen 11, the conductive film 19 on the inner surface of the funnel 13 and the second shadow mask 18 at the side of the electron guns, while a voltage lower than the anode high voltage is applied to the first shadow mask 17.

A description will now be made on the structure of the shadow masks which is the characteristic feature of the mask-focusing color picture tube of the present invention.

Figure 4A:
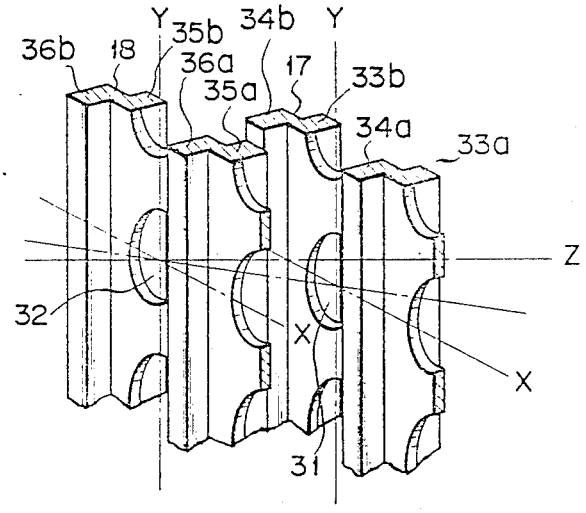
FIG. 4A is a partial enlarged view of shadow masks according to an embodiment of the present invention.
Figure 4B:
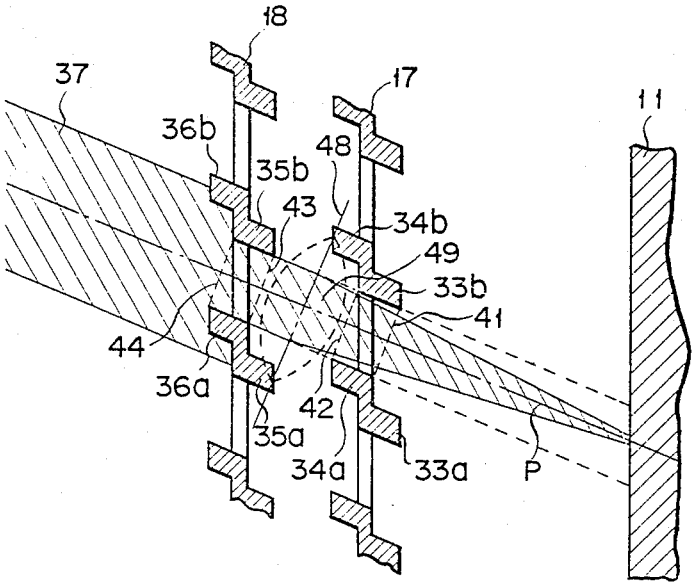
FIG. 4B is a sectional view of the shadow masks in FIG. 4A along the plane including axes X and Z.

FIG. 4A is a partial enlarged view of parts, of two shadow masks according to an embodiment of the present invention, which are at a predetermined distance from the centers O' of the shadow masks on the horizontal axis (perpendicular to the phosphor stripes,—X' axis—). FIG. 4B is a sectional view of the shadow masks in FIG. 4A along the plane including axes X and Z.

Referring to FIGS. 4A and 4B, ridge-like projections 33*a*, 33*b*, 34*a*, 34*b*, 35*a*, 35*b*, 36*a* and 36*b* vertically (in the direction of the phosphor stripes) extend on both surfaces of the first and second shadow masks 17 and 18 such that they sandwich arrays of apertures 31 and 32 formed in the masks 17 and 18, respectively. In other words, arrays of apertures and ridge-like projections are alternately formed for each of the first and second shadow masks 17 and 18.

These ridge-like projections 33*a*, 33*b*, 34*a*, 34*b*, 35*a*, 35*b*, 36*a* and 36*b* are non-symmetrical with respect to the centers of the apertures 31 or 32 interposed therebetween. This will be described in further detail with reference to the surface of the first shadow mask 17 opposing the phosphor screen 11. Referring to this surface of the first shadow mask 17, the distance from the projection 33*a* to the center of any aperture 31 is different from that from the projection 33*b* to the center of the aperture 31. The projection 33*b* is closer to the aperture 31 than the projection 33*a*. In this case, if a projection between two horizontally adjacent apertures is considered, the projection is closer to one of these apertures than the other. In other words, the projections 33*a* and 33*b* are offset by a predetermined distance from the centers of the horizontally adjacent apertures in the horizontal direction (direction perpendicular to the direction in which the projections extend). This applies to the projections formed on the other surface of the first shadow mask 17, and on both surfaces of the second shadow mask 18. However, the direction of offset differs from one surface to another. The projections 34*a*, 34*b*, 36*a* and 36*b* of the first and second shadow masks 17 and 18 on which the electron beams are incident offset toward the centers of these shadow masks. On the other hand, the projections 33*a*, 33*b*, 35*a* and 35*b* from which the electron beams emerge offset toward the periphery of the shadow masks.

The degree of offset of the projections depends upon the incident angle of the electron beam. The larger the incident angle of the electron beam or the closer toward the peripheries of the shadow masks, the greater the deviation in the positions of the projections with respect to the center of the aperture. It may be easily understood that the positions of the projections need not be offset at the central part O' of each shadow mask where the incident angle of the electron beam is close to or exactly 0°. Accordingly, a structure may be adopted wherein the measurements of offset of the projections increase toward the peripheries of the shadow masks from the vertical axes thereof (Y' axis in FIG. 3). Alternatively, another structure may be adopted wherein the measurements of offset of the projections stepwise at predetermined intervals toward the peripheries of the shadow masks from the vertical axes thereof.

With a color picture tube with the shadow masks of the structures as described above, degradation in the color purity which is encountered in the conventional shadow masks may be prevented. This will be described below with reference to FIG. 4B.

The tilt angle of the principal plane of an electrostatic lens formed between the opposing apertures of two shadow masks is determined by the plane at which the electron beam becomes incident on the aperture and the plane from which the electron beam emerges.

In the second shadow mask 18 shown in FIG. 4B, the ridge-like projection 36*a* is located at one side of the aperture 32 in the horizontal direction, and no projection is present at the other side of the aperture 32 (the projection 36*b* is at a distance from the aperture 32). Thus, the plane of incidence of the aperture 32 corresponds to a plane 44 indicated by a dotted line which connects the pointed end of the projection 36*a* with the opposing flat portion in which no projection is present. Similarly, the plane of emergence of the aperture 32 corresponds to a plane 43, the plane of incidence of the aperture 31 corresponds to a plane 42, and the plane of emergence of the aperture 31 corresponds to a plane 41, respectively. These planes 41, 42, 43 and 44 are inclined with respect to the surfaces of the first and second shadow masks 17 and 18, and may be made perpendicular to the axis p of an electron beam 37 by suitably adjusting the heights and positions of the projections. Then, a principal plane 48 of an electrostatic lens 49 formed between the apertures of the two shadow masks can be oriented perpendicularly with respect to the axis p of the electron beam 37.

Since the electron beam 37 becomes incident on the electrostatic lens 49 perpendicularly, the fluctuation in the central axis of the beam transmitted through the lens, that is, coma aberration is eliminated. Therefore, even if the focusing power of the electrostatic lens fluctuates, the central axis of the beam does not fluctuate.

The specifications of the color picture tube of the embodiment described above are, for example, as follows. The mask-focusing color picture tube was of 20" 90° deflection type. The radius of curvature of the first and second shadow masks in the horizontal direction was about 740 mm. The radius of curvature of the phosphour screen in the horizontal direction was about 790 mm. For example, at 180 mm to peripheries of the phosphor screen 11 in the horizontal direction from the center, the incident angle of the electron beams to the shadow masks was about 20° and the distance between the phosphor screen and the first shadow mask 17 was about 14.5 mm. The distance between the first and second shadow masks was about 0.5 mm. The aperture diameter of the shadow mask was 0.45 mm, and the aperture pitch (distance between the centers of the apertures) was 0.75 mm. The height of the ridge-like projections at the sides of the apertures was 0.10 mm. The positions of the ridge-like projections were horizontally offset by about 0.1 mm from the intermediate point between the two apertures sandwiching each of these projections.

In a color picture tube of the specifications as described above, when a voltage of 25 kV was applied to the metal backed layer and to the second shadow mask 18, and when the voltage applied to the first shadow mask 17 was decreased by 2 kV from 23 kV to 21 kV, the position of the center of the beam spot on the phosphor screen 11 did not fluctuate very much. For the purpose of comparison, the same test was run for a color picture tube using shadow masks wherein the positions of the ridge-like projections were not offset and were on the middle points between the horizontally adjacent apertures. With this color picture tube, when the voltage applied to the first shadow mask 17 was varied, the position of the center of the beam spot on the phosphor screen 11 changed by about 200 μm. The center of the beam spot coincided with an undesired phosphor stripe adjacent to the desired phosphor stripe, causing the miss-landing phenomenon.

In the embodiment described above, ridge-like projections which are non-symmetrical about the apertures or which are offset in their positions are formed on both surfaces of each of the two shadow masks. However, such projections may be formed on one or both surfaces of only one of the two shadow masks. It is also possible to form such projections on one surface each of the two shadow masks.

The angle formed by the principal plane of the electrostatic lens formed between the apertures of the opposing shadow masks with the axis of the electron beam may be adjustable through control of the height of the projections.

The projections are not limited to the ridge-like projections which extend from the upper side to the lower side of the shadow mask. For example, the projections may be small projections as seen in U.S. Ser. No. 351,882, which are independently formed on both sides of each aperture.

The shape of the aperture need not be circular but may be elliptic or rectangular to obtain the same effects of the present invention.

In the shadow masks of the embodiment described above, the projections extend in the same direction of the phosphor stripes, that is, the projections extend vertically, in each of the two shadow masks. However, the present invention is not limited to this. For example, shadow masks of the structure may be adopted wherein the vertically extending projections as shown in FIG. 4A are formed on the surface of the screen side shadow mask facing the electron gun side shadow mask, while projections extending perpendicularly to the phosphor stripes are formed on the surface of the electron gun side shadow mask, facing the screen side shadow mask at the side of the phosphor screen. In the shadow masks of this structure, the projections formed on the facing surfaces of the two shadow masks extend perpendicularly to each other, and an electrostatic lens formed between the corresponding apertures is a quadrupole lens. The shadow masks of such a structure is shown in U.S. Ser. No. 351,882 in detail. At the peripheries of the shadow masks of this structure, the central axis of the electron beam does not coincide with the center of the quadrupole lens and is not subject to the uniform focusing power by the quadrupole lens. Therefore, the axis of the electron beam which has passed through the quadrupole lens fluctuates with fluctuations in the focusing power. This problem may be solved by offsetting the positions of the projections formed on the shadow mask at the periphery of the phosphor screen. This will be described below with reference to FIG. 5.

Figure 5:
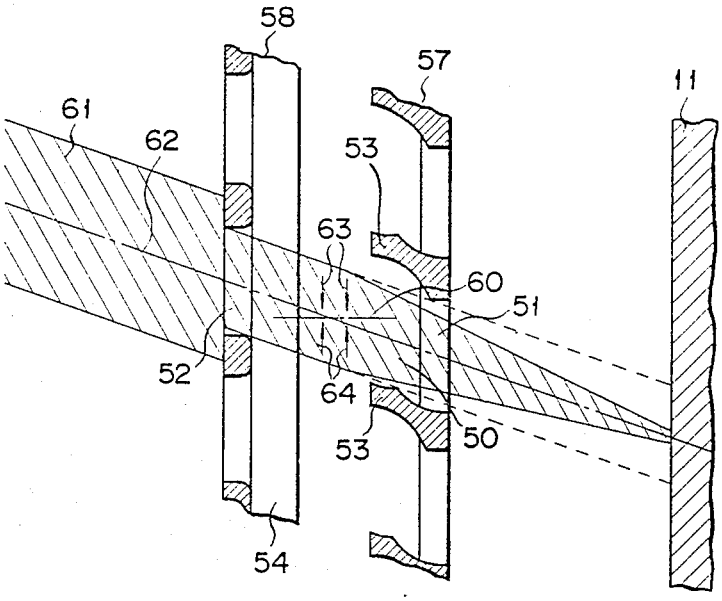
FIG. 5 is a sectional view of shadow masks along a horizontal plane according to another embodiment of the present invention.

FIG. 5 is a sectional view of side parts of shadow masks away from the centers thereof along a horizontal axis. Referring to FIG. 5, ridge-like projections 53 are formed on the surface of a first shadow mask 57 facing a second shadow mask 58 to be non-symmetrical about an aperture 51 or extend vertically at positions offset from the center of the aperture 51 toward the central part of the first shadow mask 57. On the other hand, ridge-like projections 54 extend horizontally on the surface of the second shadow mask 58 facing the first shadow maks 57. When the projections 53 are arranged to be non-symmetrical about the center of the aperture 51, the middle point between the projections 53 or a center 60 of the electrostatic lens is moved from the center of the aperture 51 in the same direction of offset of the projections. Thus, an electron beam 61 is subjected to focusing powers 63 and 64 which are substantially equal to each other. As a consequence, a central axis 62 of the electron beam 61 which has passed through the apertures 51 and 52 may not fluctuate with fluctuations in the potential difference between the shadow masks 57 and 58 or in the intensity of the electrostatic lens.

Figure 6:
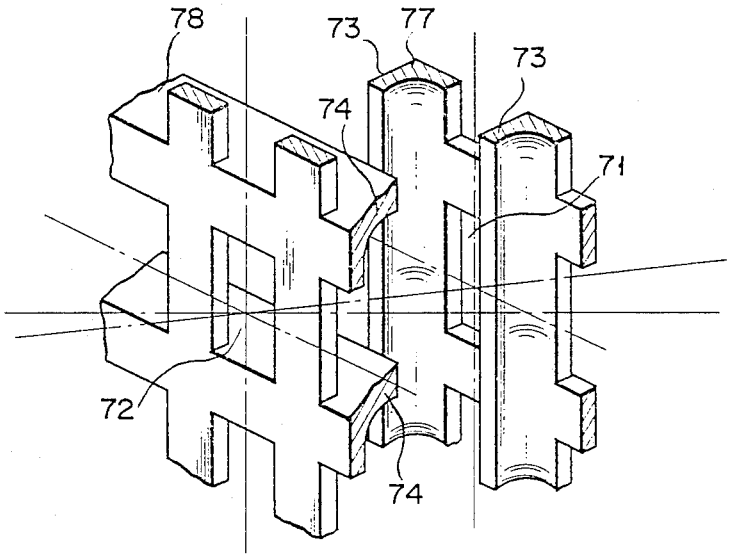
FIG. 6 is a partial enlarged view of shadow masks according to still another embodiment of the present invention.

In the embodiment shown in FIG. 5, the horizontally extending ridge-like projections 54 formed on the second shadow mask 58 are symmetrical about the center of each aperture. However, these ridge-like projections 54 may be increasingly vertically offset toward the upper and lower sides of the shadow mask from the horizontal axis thereof as in the case of the horizontally offsetting ridge-like projections 53 formed on the shadow mask 57. FIG. 6 shows an embodiment of shadow masks wherein both of the horizontally and vertically extending projections are non-symmetrical about the centers of the apertures or are offset therefrom. The shadow masks structure showed in FIG. 6 is at some distance from the center O' of the shadow mask in the direction of horizontal and in the direction of vertical. Referring to FIG. 6, ridge-like projections 73 formed on the surface of a first shadow mask 77 opposing a second shadow mask 78 as well as ridge-like projections 74 formed on the surface of the second shadow mask 78 opposing the first shadow mask 77 are both non-symmetrically about the centers of apertures 71 and 72 or are deviated therefrom. In this case, the projections 74 are deviated toward the upper and lower sides of the shadow mask unlike the direction of deviation of the projections 73.

The shadow masks shown in FIG. 6 may be manufactured by coating one surface of an iron plate with a mask pattern for apertures and another surface of the iron plate with a stripe-shaped mask pattern which is non-symmetrical about the centers of these apertures, and then etching the iron plate through these mask patterns.

The present invention has been described with reference to the embodiments of mask-focusing color picture tubes having two shadow masks. However, the present invention is similarly applicable to mask-focusing color picture tubes having a plurality of shadow masks.

What is claimed is:

1. A mask-focusing color picture tube comprising:

an evacuated envelope; means for generating a number of electron beams; a display screen including a large number of phosphor stripes luminescing in different colors; and a plurality of shadow masks spaced a predetermined distance from each other, each of said plurality of shadow masks defining a number of apertures arranged in rows and disposed in the vicinity of said screen, each electron beam being assigned to one of said large number of phosphor stripes of a respective color through a corresponding one of said number of apertures, wherein at least one of said plurality of shadow masks includes a plurality of projections on at least one surface of said one shadow mask, said projections being separated from each other by the rows of said number of apertures defined by said one shadow mask, the projections at the central part of said one mask being located at symmetrical positions with respect ot the centers of said apertures defined by said one mask, at least part of the projections at the peripheral part of said one mask being located at asymmetrical positions with respect to the centers of said number of apertures defined by said one mask.

2. A mask-focusing color picture tube according to claim 1, wherein said projections are disposed on that surface of one of said plurality of shadow masks which faces another of said plurality of shadow masks.

3. A mask-focusing color picture tube comprising:

an evacuated envelope; means for generating a number of electron beams; a display screen comprising a large number of phosphor stripes luminescing in different colors; and a plurality of shadow masks spaced a predetermined distance from one another, each of said plurality of shadow masks defining a number of apertures which are arranged in rows and are disposed in the vicinity of said screen, each electron beam being assigned to one of said large number of phosphor stripes of a respective color through a corresponding one of said number of apertures, wherein at least two opposing ones of said plurality of shadow masks each include a plurality of projections disposed on the respective opposing surfaces of said two masks, said projections of each of said two masks being separated from each other by the rows of said number of apertures defined by each of said two masks, the projections at the central part of at least one of said two masks being located at symmetrical positions with respect to the centers of said apertures defined by one of said two masks, at least part of the projections at the peripheral part of said one mask being located at asymmetrical positions with respect to the center of said number of apertures defined by one of said two masks.

4. A mask-focusing color picture tube according to claim 3, wherein at least part of said projections at the peripheral part of the other one of said two shadow masks is located at asymmetrical positions with respect to the centers of the apertures defined by the other one of said two shadow masks.

5. A mask-focusing color picture tube according to claim 3, wherein said projections of each of said two masks are substantially disposed in rows which are substantially parallel to the rows of said apertures, and the rows of said projections of one of said two masks are substantially perpendicular to the rows of said projections of the other of said two masks.

6. A mask-focusing color picture tube according to claim 3 or 4, wherein said projections of each of said two masks are substantially disposed in rows which are substantially parallel to the rows of said apertures, and the rows of said projections of one of said two masks are substantially parallel to the rows of said projections of the other of said two masks.

7. A mask-focusing color picture tube comprising: an evacuated envelope; means for generating a number of electron beams; a display screen comprising a large number of phosphor stripes luminescing in different colors; and a plurality of shadow masks spaced a predetermined distance from one another, each of said plurality of shadow masks defining a number of apertures which are arranged in rows and are disposed in the vicinity of said screen, each electron beam being assigned to one of said large number of phosphor stripes of a respective color through a corresponding one of said number of apertures, wherein at least two opposing ones of said plurality of shadow masks each include a plurality of projections on all surfaces of said two shadow masks, said projections being separated from each other by the rows of said number of apertures defined by each of said shadow masks, the projections at the central part of at least one of said two masks being located at symmetrical positions with respect to the centers of said apertures defined by said one mask, at least part of the projections at the peripheral part of said one mask being located at asymmetrical positions with respect to the center of said number of said apertures defined by said one mask.

8. A mask-focusing color picture tube according to any one of claims 1, 3 and 7, wherein said projections are continuously elongated along the rows of said apertures.

9. A mask-focusing color picture tube according to any one of claims 1, 3 and 7, wherein said projections are independently disposed along the rows of said apertures.

10. A mask-focusing color picture tube according to any one of claims 1, 3 and 7, wherein the non-symmetrical positions of said projections are determined in accordance with an incident angle of said electron beam.

11. A mask-focusing color picture tube according to any one of claims 1, 3 and 7, wherein the non-symmetrical positions of said projections gradually change toward peripheries of said shadow masks from the centers thereof.

12. A display tube comprising:

an evacuated envelope including a phosphorescent surface;

electron gun means disposed in said envelope for producing an electron beam;

deflecting means disposed in said envelope for deflecting said electron beam toward said phosphorescent surface;

first shadow mask means, disposed in proximity to said phosphorescent surface, for focusing said electron beam onto said phosphorescent surface, said first mask means including means for defining a first surface, said first mask means further including means for defining a first plurality of apertures in said first surface, said first mask means adapted to receive a first electrical potential;

second shadow mask means, disposed in proximity to said first shadow mask means, for focusing said electron beam onto said phosphorescent surface, said second mask means including means for defining a second surface which opposes said first surface defined by said first mask means, said second mask means further including means for defining a second plurality of apertures in said second surface in registry with said first plurality of apertures, said second mask means adapted to receive a second electrical potential; and a plurality of projecting means, disposed on at least one of said first and second surfaces, for strengthening the focusing power of said first and second mask means, the projection means at the central part of at least one of said first and second shadow mask means being located at symmetrical positions with respect to the centers of said plurality of aperture defined by said mask means, at least part of th projection means at the peripheral part of said mask means being located at asymmetrical positions with respect to the center of said plurality of apertures defined by said mask means.

13. A display tube as in claim 12 wherein a first plurality of said conductive projecting means are disposed on said first surface and a second plurality of said conductive projecting means are disposed on said second surface.

14. A display tube as in claim 12 wherein:

said means for defining said first and second plurality of apertures each includes means for defining a plurality of rows each of which comprises a plurality of apertures; and each one of said plurality of projecting means is positioned on said one surface a predetermined distance from an associated one of said rows of apertures defined in said one surface depending upon the angle of incidence of said electron beam with the apertures comprising said associated row.

15. An electrostatic lens for focusing an electron beam comprising:

a first shadow mask adapted to received a first electrical potential, said first mask including:

means for defining a first surface; and means for defining a first plurality of apertures in said first surface;

a second shadow mask disposed in proximity to said first shadow mask, said second shadow mask adapted to receive a second electrical potential, said second shadow mask including:

means for defining a second surface parallel to and opposing said first surface; and means for defining a second plurality of apertures in said second surface in registry with said first plurality of apertures; and a plurality of projecting means, disposed on at least one of said first and second surfaces, for strengthening the focusing power of said first and second mask means, the projection means at the central part of at least one of said first and second shadow mask means being located at symmetrical positions with respect to the centers of said plurality of aperture defined by said mask means, at least part of the projection means at the peripheral part of said mask means being located at asymmetrical positions with respect to the center of said plurality of apertures defined by said mask means.

16. An electrostatic lens as in claim 15 wherein a plurality of said conductive projecting means are disposed on each of said first and second surfaces.

17. An electrostatic lens as in claim 15 wherein:

said means for defining said first plurality of apertures and said means for defining said second plurality of apertures each define a plurality of rows, each of said rows comprising a plurality of apertures; and each of said plurality of projecting means is positioned a predetermined distance from each of the apertures in one of said plurality of rows of apertures defined in said one surface, said predetermined distance being dependent upon the angle of incidence of said electron beam with said apertures comprising said one row.

* * * * *